United States Patent [19]

Melov et al.

[11] Patent Number: 4,657,258

[45] Date of Patent: Apr. 14, 1987

[54] GOLFER'S STANCE POSITIONING DEVICE

[76] Inventors: Martin Melov, 82 Hardie Street, Mascot N.S.W. 2020; Francis C. Walsh, 37 Eyre Street, Chifley, N.S.W. 2036, both of Australia

[21] Appl. No.: 792,549

[22] Filed: Oct. 29, 1985

[30] Foreign Application Priority Data

Nov. 8, 1984 [AU] Australia ..... PG8023

[51] Int. Cl.[4] ..... A63B 69/36

[52] U.S. Cl. ..... 273/187 R; 273/195 A

[58] Field of Search ..... 273/187 R, 183 A, 187 A, 273/187 B, 195 A

[56] References Cited

U.S. PATENT DOCUMENTS 2,189,613 2/1940 Paulsen ..... 273/187 R 3,244,421 4/1966 Hanna ..... 273/187 R 3,423,094 1/1969 Auslander et al. ..... 273/187 R 3,658,344 4/1972 Kimble ..... 273/187 R

*Primary Examiner*—George J. Marlo

*Attorney, Agent, or Firm*—Dellett, Smith-Hill & Bedell

[57] ABSTRACT

An aid for teaching a golfer how to position his feet correctly when executing a drive, comprises a base having two relatively movable supports for the golfer's feet. The back-foot support has a half-shoe for locating the instep of the back-foot and which can rotate about a vertical axis while simultaneously allowing the golfer to raise his heel. Stops prevent the golfer from moving his feet further than permitted by the aid, during the execution of the stroke. A horizontal pivotal axis on the back-foot support permits the half-shoe to tilt when the golfer's heel is raised.

3 Claims, 4 Drawing Figures

GOLFER'S STANCE POSITIONING DEVICE

FIELD OF THE INVENTION

This invention relates to an aid for helping gofers to improve their play and is more specifically concerned with helping a golfer to acquire the correct foot movements to enable a golf ball to be driven accurately and consistently along a desired trajectory.

STATE OF THE ART

A common golfing fault is to adopt an incorrect stance when addressing a golf ball and to transfer his weight between the feet incorrectly while driving the ball. The United States magazine "GOLF", August edition 1985, carries on pages 32 to 35 an article by Mr. M. Dunaway which illustrates with a sequence of photographs the way the stance of a golfer should change during the backswing and downswing of a golf club in order to obtain the correct transfer of weight between the feet. This article, hereby inserted by way of reference, shows the way in which the golfer's feet alter their positions during the execution of a drive shot.

Australian Pat. No. 484,021 in the name of Oliver Thomas Spedding describes apparatus for assisting a golfer to position his feet correctly during a golf drive. The apparatus described uses two foot rests mounted to rotate about parallel axes, and a guard which prevents the golfer's lower leg advancing beyond one of the foot rests.

OBJECT OF THE INVENTION

An object of the invention is to provide an improved aid for assisting a golfer to move his feet correctly during the execution of a golf drive.

SUMMARY OF THE INVENTION

In accordance with the present invention a golf aid comprises a base having a front foot locator and a back foot support adjustably spaced from the locator, means for trapping a toe-portion of a golfer's shoe on the back foot support, a first pivotal connection allowing the back foot support to rotate about an upright axis, and a second pivotal connecting allowing the support to tilt about a horizontal axis to permit the golfer to raise his heel while turning in the direction of the drive.

PREFERRED FEATURES OF THE INVENTION

It is convenient to have the front foot locator attached to the base in a way which permits it to be turned through a small angle and repositioned with respect to the back foot support, and then clamped in a desired new position which enables the golfer to stand comfortably before commencing the back swing of the golf club.

It is preferred to have the base reversible and the locator and support attached to it in a way which enables them to be removed and attached to the same positions on the other side of the base. This enables left or right-handed golfers to use the same golf aid simply by inverting it and repositioning the support on its upper surface.

Suitably the second pivotal connection on the back foot support is disconnectable by the golfer rocking his shoe sideways. It is then easy for the golfer to remove both his feet from the aid if he feels he is in danger of losing his balance.

INTRODUCTION TO THE DRAWINGS

The invention will now be described in, more detail, by way of example, with reference to accompanying drawings, in which.

DESCRIPTION OF PREFERRED EMBODIMENT

Figure 1:
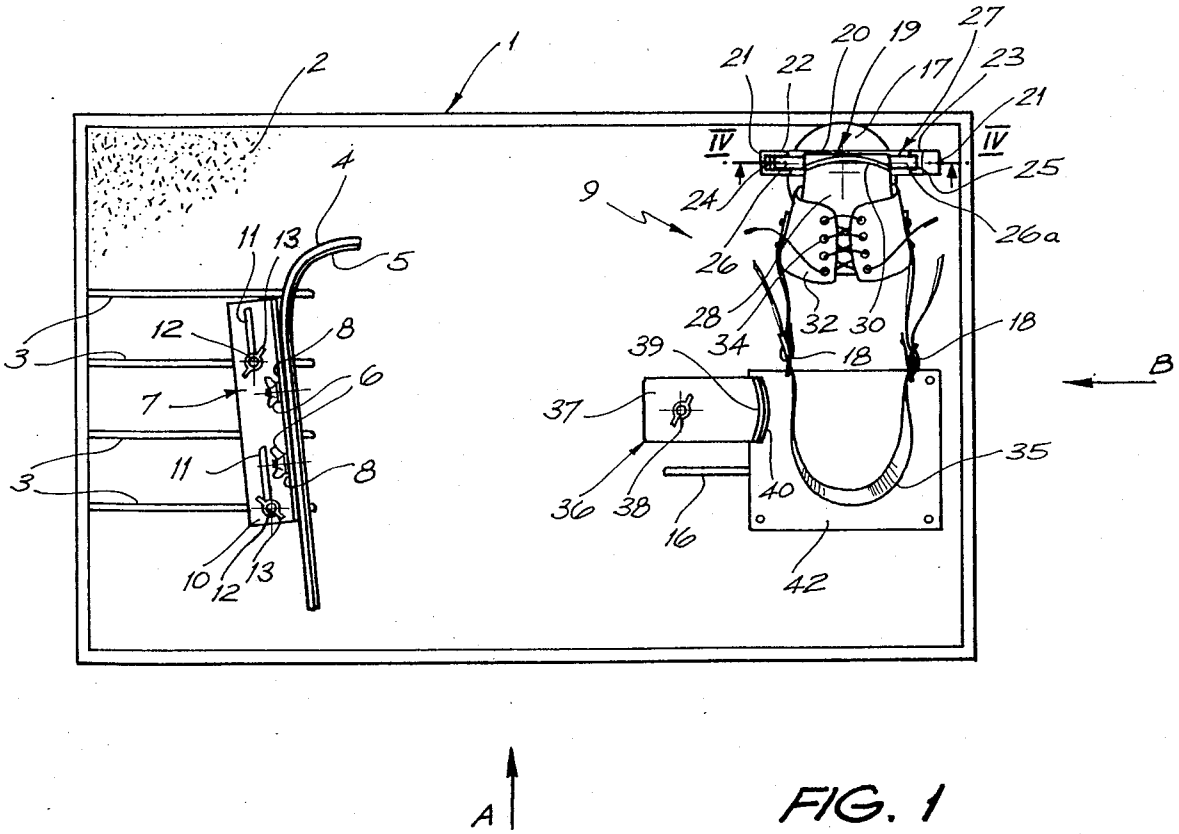
FIG. 1 is a plan view of a golf aid.
Figure 2:
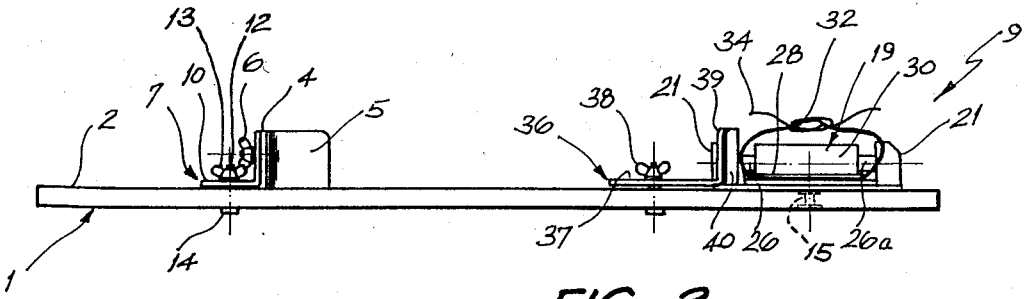
FIG. 2 is a side view of the golf aid as viewed in the direction of the arrow 'A' in FIG. 1.
Figure 3:
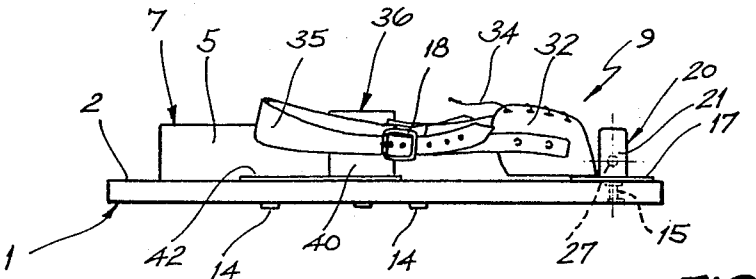
FIG. 3 is an end view of the golf aid as viewed in the direction of the arrow 'B' in FIG. 1.

The golf aid shown in FIG. 1 comprises a base 1 covered with a plastics grass finish 2 and of rectangular shape. Four slots 3 extend parallel to one another from one shorter end of the base and are equally spaced. A front foot locator 4 having a concave surface lined with a non-slip rubber layer 5 is attached by a pair of bolts 6 to an angle plate 7. The bolts 6 pass through horizontally extending slots 8 in the angle plate 7 and can be clamped to it by nuts.

The angle plate 7 has a horizontal limb 10 provided with two horizontal aligned slots 11 through which pass respective bolts 12. Wing nuts 13 enable the angle plate 7 to be clamped in a releasable manner to the base 1 by way of the bolts 12 which pass upwardly through a chosen two of the slots 3 and have their domed heads 14 on the underside of the base 1. The bolts 12 which attach the angle plate 7 to the base 1 and locator 4 enable the position of the locator to be varied to suit the comfort of a golfer standing on the base 1.

A back foot support 9 on the aid is provided by a metal disc 17 flush with the upper surface of the base 1 and rotatable about a vertical axis provided by a first pivotal connection beneath it. The pivotal connection is provided by a vertical shaft 15 mounted in vertical bore in the base so that the disc 17 can be removed from the bore and replaced on the other side of the base after it has been inverted.

A channel-shaped stirrup 20 is bolted to the upper face of the disc 17 and provides two spaced posts 21 having opposed slots 22 and 23. The slot 22 has a convex end wall 24 and the slot 23 has a concave end wall 25 of longer radius of curvature than that of the end wall 24.

The slots 22 and 23 serve to accommodate opposite end-portions 26,26A of a horizontal shaft 27 providing a second pivotal connection. The shaft 27 is integrally formed with an L-shaped plate 19 having a horizontal limb 28 and a vertical limb 30. The horizontal limb 28 has attached to it a shoe retainer 32 tightenable by a lacing 34 and for trapping within it a toe-portion of a golfer's shoe. The shoe is held in position by a heel strap 35 provided with length-adjustment buckles 18.

An angle bracklet 36 has a horizontal arm 37 attached to the base 1 by a nut and bolt 38 which passes through a slot 16 in the base 1. A vertical arm 39 of the bracket 36 is faced with a rubber non-slip layer 40 for engaging one side of a heel portion of the golfer's shoe. A base plate 42 duplicated on the other side of the base board 1, provides a foot rest for the heel of the golfer's shoe.

OPERATION OF THE PREFERRED EMBODIMENT

To use the golf aid the golfer manually disconnects the second pivotal connection by tilting the shaft 27 so that its end-portions 26,26A disengage from the slots 22 and 23. He then fits the toe portion of his shoe into the shoe retainer 32 after the laces 34 have been loosened, and the laces and the heel strap 35 are then tightened so that the golfer's shoe is firmly trapped in the shoe retainer 32.

The golfer then re-engages the shaft 27 in the slots 22 and 23 to restore the second pivotal connection. The ball of his foot is now positioned above the horizontal limb 28 of the bracket L-shaped plate 19.

The bolts 6 and 12 are loosened to allow the front foot locator to engage against the side of the golfer's front foot remote from his back foot, when his two feet are comfortably spaced from one another on the base. The bolts are then tightened so that the locator is clamped in the chosen position and its curvature prevents the front foot sliding in the direction of the golf drive or the direction in which the golfer's front foot is pointing. Finally the angle bracket 36 is turned and adjusted lengthwise of the slot 16 until its vertical arm 39 engages against the inside edge of the golfer's shoe.

The golfer executes his shot as shown in the Dunaway article referred to above. The front foot locator allows the golfer to roll the sole of his front shoe sideways during the execution of the shot. The back foot support allows the golfer to raise his heel during the execution of the drive by permitting rocking of the plate 9 about the horizontal axis of the shaft 27 while simultaneously permitting the golfer to turn his foot in the direction of the drive. This is permitted by the rotation of the disc 17 on the vertical axis of the shaft 15. However the golfer is prevented from varying the distance between his two feet.

It is found that when the aid is set up to suit the stance of a golfer, the head of the club will pass through substantially the same ball-striking position on the ground repeatedly. Also the grip of the golfer's hands on the club will naturally assume the correct grip.

It will be noticed that there is no fitting holding the golfer's feet rigidly to the base 1. He may remove both feet easily from the base 1 without having to use his hands.

Figure 4:
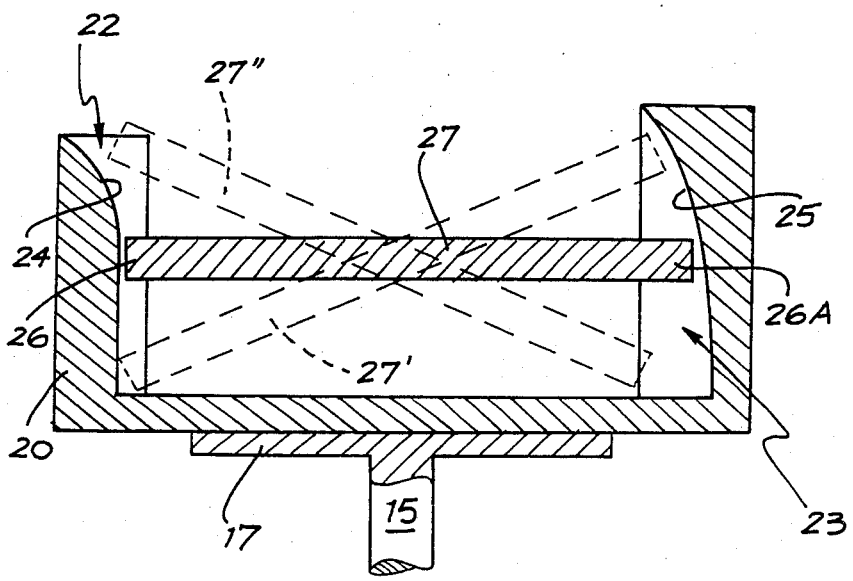
FIG. 4 is an enlarged vertical section through part of FIG. 1 taken on the line and in the direction of the arrows IV—IV in that figure.

The inherent safety of the aid together with its ability to control closely the position of the golfer's feet during his execution of a drive, will be apparent from FIGS. 1 and 4. If the golfer should overbalance to the left, that is to say in the forward direction, he can lift his left or forward foot over the locator 4, shown in FIG. 1, to restore his balance. Although the golfer's right foot is held in a way which allows it to turn and tilt, it cannot displace horizontally during the execution of a drive. Nevertheless, the golfer is able to separate his foot easily from the back-foot support 9 by appropriately tilting the shaft 27, and such separation takes place automatically if the golfer overbalances to the right. This result is achieved because the two curved walls 24, 25 guide sideways tilting of the shaft 27 moving from the solid outline position indicated in FIG. 4 to the broken outline position referenced 27'. However if the golfer overbalances to the right in FIG. 1 while attempting to execute a drive, the two curved walls 24, 25 allow the shaft to tilt to the position shown by the broken outline 27''. As the curvature of the wall 24 is greater than that of the wall 25, the shaft 27 can displace axially to the left, to disengage the shaft 27 and thus the golfer's back foot automatically from the back-foot support 9.

Should the golfer be left-handed, the locator, bracket and support can be detached from the face of the board shown in FIG. 1, the base turned upside down and the same parts repositioned on its upper surface after releasing the nuts 6 and turning the front-foot locator 4 end-to-end before re-applying the nuts 6. The positions they then occupy are reversed and the aid is thus suitable for use by a left-handed golfer.

We claim:

1. A golf driving aid, comprising a base board, front-foot locating means on said base board, a portion of said locating means being upstanding and concave to locate a forward side edge of a golfer's front shoe, back-foot support means on said base board, adjustment means on said base board operable to vary the spacing between said locating means and said support means in accordance with the spacing desired between the golfer's feet when driving, first pivotal connection means between said support and said base board and providing for rotation of said support means about an upright axis with respect to said base board, channel means on said support means, spaced sidewalls on said channel means formed with opposed upright forward and rearward slots respectively, a convex end-wall provided in the forward one of said slots and a concave end-wall provided in the rearward one of said slots, the vertical curvature of the convex end-wall being greater than the vertical curvature of said concave end-wall, second pivotal connection means provided by shaft means extending horizontally across said channel means, opposite shaft end-portions of said shaft means being located in said slots respectively and being rotatable therein and displaceable upwardly thereon to a position at which upward tilting of the forward end of the shaft means with respect to the rearward end of the shaft means disengages the shaft means from the slots and from the support means, and golfer's shoe retaining means fixedly-connected to said shaft means.

2. A golf driving aid as set forth in claim 1, in which said base board is reversible, the locating means and back-foot support means are attachable to opposite sides of the board each at its respective position, and the upstanding portion of said locating means is detachably mounted and reversible end-for-end on said locating means.

3. A golf driving aid as set forth in claim 2, in which said locating means is attached to said base board by removable clamping bolts passing through parallel slots extending through said base board.

* * * * *